US010676165B2

(12) United States Patent
Miller

(10) Patent No.: US 10,676,165 B2
(45) Date of Patent: Jun. 9, 2020

(54) ADJUSTABLE FIN SYSTEM

(71) Applicant: Flying Fin Systems PTY LTD, Margaret River (AU)

(72) Inventor: Glenndin George Miller, Margaret River (AU)

(73) Assignee: Flying Fin Systems Pty Ltd (AU)

( * ) Notice: Subject to any disclaimer, the term of this patent is extended or adjusted under 35 U.S.C. 154(b) by 0 days.

(21) Appl. No.: 15/936,166

(22) Filed: Mar. 26, 2018

(65) Prior Publication Data

US 2019/0039696 A1 Feb. 7, 2019

Related U.S. Application Data

(63) Continuation of application No. 15/110,392, filed as application No. PCT/AU2015/050241 on May 14, 2015, now Pat. No. 9,926,051.

(30) Foreign Application Priority Data

| | | |
|---|---|---|
| May 15, 2014 | (AU) | 2014901808 |
| Mar. 30, 2015 | (AU) | 2015901152 |
| Apr. 29, 2015 | (AU) | 2015901529 |

(51) Int. Cl.

| | |
|---|---|
| ***B63B 1/00*** | (2006.01) |
| ***B63B 35/00*** | (2020.01) |
| ***B63B 35/79*** | (2006.01) |

(52) U.S. Cl.

CPC ..... *B63B 35/793* (2013.01)

(58) Field of Classification Search

CPC ... B63B 35/79; B63B 35/7926; B63B 35/793; B63B 2035/79

(Continued)

(56) References Cited

U.S. PATENT DOCUMENTS

| | | | |
|---|---|---|---|
| 3,564,632 | A | 2/1971 | Bahne |
| 3,579,681 | A | 5/1971 | Pope, III |

(Continued)

FOREIGN PATENT DOCUMENTS

| | | |
|---|---|---|
| DE | 32 06 057 | 9/1983 |
| EP | 0 079 113 | 5/1982 |
| WO | WO-2007/048172 | 5/2007 |

OTHER PUBLICATIONS

First Examination Report for AU application 2015258777, dated Feb. 18, 2016, 3 pages.

(Continued)

*Primary Examiner* — Daniel V Venne

(74) *Attorney, Agent, or Firm* — Patshegen IP LLC; Moshe Pinchas

(57) ABSTRACT

An adjustable fin for use on a surfboard, the adjustable fin comprising: a base which comprises a mounting means for mounting the adjustable fin to a surfboard, and a member extending in a direction contrary to the mounting means. The adjustable fin further comprises a fin section comprising two outer fin surfaces which meet at a leading edge and a trailing edge; an underside surface comprising an opening to an internal cavity, the internal cavity configured to house the member and enable slidable movement of the member in a direction towards the leading edge or the trailing edge; and a locking means that is manipulate and which projects into the internal cavity, wherein the locking means can releasably couple to the member at one of two or more locking positions thereby preventing slidable movement of the member. The fin section can be adjusted relative to the base by manipulating the locking means to uncouple the locking means from the member at a first locking position, slidably move the member through the internal cavity, and releasably (Continued)

couple the locking means to the member at a second locking position.

17 Claims, 6 Drawing Sheets

(58) Field of Classification Search
USPC ..... 441/65, 74, 79
See application file for complete search history.

(56) References Cited

U.S. PATENT DOCUMENTS

| | | | | |
|---|---|---|---|---|
| 3,585,663 | A | 6/1971 | Johnson | |
| 4,325,154 | A | 4/1982 | Collum, Jr. | |
| 4,340,376 | A | 7/1982 | Williams | |
| 4,733,496 | A * | 3/1988 | Wallner | B63B 35/793 114/133 |
| 4,846,745 | A | 7/1989 | Lobe | |
| 4,964,826 | A | 10/1990 | Lobe | |
| 5,356,324 | A | 10/1994 | Cunningham | |
| 6,053,789 | A * | 4/2000 | Miyashiro | B63B 35/7926 114/140 |
| 7,481,690 | B2 | 1/2009 | Shibata | |
| 7,896,718 | B2 * | 3/2011 | Jones | B63B 35/7926 441/79 |
| 8,083,560 | B2 | 12/2011 | Foulke | |
| 2003/0220030 | A1 | 11/2003 | Jolly | |
| 2005/0260903 | A1 | 11/2005 | Batt | |
| 2010/0120305 | A1 | 5/2010 | Posner et al. | |
| 2010/0233921 | A1 | 9/2010 | Kumano et al. | |
| 2012/0040575 | A1 | 2/2012 | Schultz, III | |
| 2014/0080371 | A1 | 3/2014 | Hill et al. | |

OTHER PUBLICATIONS

International Search Report and Written Opinion for PCT/AU2015/050241, dated Jul. 1, 2015, 13 pages.
Notice of Acceptance for AU application 2015258777, dated Apr. 6, 2016, 7 pages.
Supplementary European Search Report for EP 15792477.0, dated Jan. 16, 2018, 8 pages.

* cited by examiner (A)

ADJUSTABLE FIN SYSTEM

CROSS REFERENCE TO RELATED APPLICATIONS

This application is a continuation of U.S. Ser. No. 15/110,392 having an international filing date of 14 May 2015, now allowed, which is a U.S. National Phase Application of International Application No. PCT/AU2015/050241 having an international filing date of 14 May 2015, which claims the benefit of earlier filing date and right of priority to Australian Patent Application Nos. 2014901808, filed on 15 May 2014; 2015901152, filed on 30 Mar. 2015; and 2015901529, filed on 29 Apr. 2015. The contents of the above patent applications are incorporated by reference herein in their entirety.

TECHNICAL FIELD

The present invention relates to an adjustable fin for a surfboard. More particularly, the invention relates to a surfboard fin or dual surfboard fin that can be adjusted by hand without the need for any tools.

BACKGROUND ART

The following discussion of the background art is intended to facilitate an understanding of the present invention only. The discussion is not an acknowledgement or admission that any of the material referred to is or was part of the common general knowledge as at the priority date of the application.

A surfboard, stand-up paddleboard (SUP), or similar type of board for use in water sports and other activities can be viewed in one sense as a summation of hydrodynamic surfaces. The surface of the bottom of the board in contact with water generates lift and affects speed. More importantly though, it is the fins working in collaboration with rail and bottom contour that most influence the feel of the board when changing direction. Since the form shape of surfboards including the rails and bottom surface has undergone finer and finer adjustments over the past few decades, the largest gains that can still be made to a board's performance is in fin modification.

Predominant factors that influence the effect of the fins include (i) foil shape, and the curve from leading to trailing edge as it changes from base to tip; (ii) template shape, which is the combination of depth, width, and rake that make up the profile of the fin; (iii) stability and flex, which can depend on the materials from which a fin is made; and (iv) fin placement, which comprises tow and camber of the fins, the distance between the fins, and the distance of the fins from the rear of the board.

Foils comprise surfaces which affect lift and drag. Where one surface of a foil is curved and the other, predominantly flat (a 'flat foil'), it takes less effort (drag) for liquid to flow past the flat surface as the path of least resistance than the curved surface. As a result, more water will flow past the flat surface of the foil creating an area of high pressure. Conversely, an area of low pressure is created adjacent to the curved surface of the foil. This difference in pressure creates lift towards the curved side of the foil. The more curve a foil has, the more drag it induces over the curved surface which means that a foil with greater curvature will have more lift at lower speeds. The problem is at higher speeds that additional drag will develop turbulence and stall the flow across the foil. Side fins on a surfboard are usually flat foils which are oriented with the flat face of the foil facing towards the centre or stringer of the board. The resulting pressure differential assists to pull the board fins and rail of the surfboard down into the water. Therefore, thicker, more curved foils are preferred by surfers for slow waves, and flatter, finer foils for faster waves.

Template shape affects stability and control. As an example, fins that are deeper, with a wider base and more rake provide greater stability and control as a result of a relatively large surface area. However, more surface area causes greater drag and slows a board down. As a generalisation known amongst surfers, fins with a greater surface area are more preferred for steep and heavy waves, choppy and irregular conditions, for heavier surfers, and/or surfers with a flowing style. Alternatively, fins with less surface area are more preferred for sloped, clean and glassy waves, for lighter surfers, and/or surfers that exercise extreme and radical manoeuvres.

The flex of a surfboard fin can affect stability in turns. For example, a flexible tip on a fin can dampen or smooth out some of the bite when a surfer changes direction on a surf board. But a stable fin base is crucial to prevent or minimise turbulence which can generate drag and disturb the lift causing loss of fin control, making the board slow and out of control. Less flex can make turns more off a pivot.

'Toe' can be considered in terms of the angle the base of the side fins are pointed in towards the centre of the board relative to the leading edge and trailing edge at the base. 'Cant' can be considered in terms of the angle the body of a fin is set at relative to the bottom surface of the board in a plane perpendicular to the direction of the stringer. Both toe and cant affect the 'angle of attack' of fin foils in their movement through the water. A greater angle forces more water flow around the outside curved surface of the foil at lower speeds making it easier to initiate turns on slower waves. However, too much angle at higher speeds increases turbulence and drag slowing down the board.

Since the introduction of removable fins about two decades ago by FCS®, there has been a greater interest from surfers and particularly professional surfers in fin placement in addition to the other factors described above. While fin placement is often left to convention, for example, with many board shapers following the benchmark for approximate location set by Simon Anderson more than thirty years ago, many other board shapers have their personal preference for each surf board model they shape. There are, however, subtle differences in most boards and in all riders. An adjustment of the position of a fin as small as a 4 mm fin movement fore or aft in either or both the centre fin or side fins can have a profound effect on the performance of a board, similar to a change of fin size or template. In general terms, moving a fin towards the rear of the board will stiffen the board, allowing it to handle greater speed and irregular water conditions. Moving a fin forward will loosen the board allowing it to turn on a tighter radius for easier changes in direction, and is preferable in glassy water conditions and short beach surf breaks.

Removable fin arrangements and systems have therefore been designed, with some available for purchase, which allow a surfer to adjust the position of a fin on their surfboard, and in some cases, even the tow and cant of the fin. However, these removable and adjustable fin arrangements commonly attach to their own unique and custom fin box or plug requiring a new board or modifications to an existing board. Many of these adjustable fin arrangements also require tools to be carried by the surfer to adjust the position of the fins on the board. As a result, there has been a relatively small uptake of these adjustable fin arrangements by the millions of surfers and other board riders around the world.

SUMMARY OF THE INVENTION

First Embodiment

In a first embodiment, the invention provides an adjustable fin for use on a surfboard, the adjustable fin comprising:

a base comprising:

- a mount for mounting the adjustable fin to a surfboard; and
- an insert member extending in a direction contrary to the mount;

a fin section comprising:

- two outer fin surfaces which meet at a leading edge and a trailing edge;
- an underside surface comprising an opening to an internal cavity, the internal cavity configured to house the insert member and enable slidable movement of the insert member in a direction towards the leading edge or the trailing edge; and
- a lock that is manipulable and which projects into the internal cavity, wherein the lock can releasably couple to the insert member at one of two or more locking positions thereby preventing slidable movement of the insert member;

wherein the fin section can be adjusted relative to the base by manipulating the locking-mean to uncouple the lock from the insert member at a first locking position, slidably move the insert member through the internal cavity, and releasably couple the lock to the insert member at a second locking position.

In a preferred example, the lock is biased towards being releasably coupled to the insert member at a locking position.

In another preferred example, the lock is manipulable from an outer fin surface. The lock preferably comprises a button at an outer fin surface for manipulating the lock, and depressing the button uncouples the lock from the insert member. Releasing the button preferably releasably couples the lock to the insert member at a locking position.

The insert member is preferably substantially planar, comprising a flat or substantially flat surface. Preferably, the planar insert member is approximately 1 mm thick. In a preferred example, the insert member comprises a hole, and the hole is configured to receive the lock. Preferably, the lock releasably couples to the insert member at any one of two or more locking positions in the hole. More preferably, the lock passes through the hole which maintains engagement between the base and the fin section.

In a preferred example, the hole in the insert member comprises one or more teeth, wherein either side of a tooth can be a valley, and a valley can form a locking position. The peak of the teeth may be pointed or rounded in shape. Preferably, the one or more teeth are aligned substantially parallel to the underside surface, and point in a direction contrary to the underside surface. That is, the peak of the one or more teeth preferably point in a direction contrary to the underside surface and mount.

At least a portion of the lock is preferably received at a locking position in a valley thereby coupling the lock to the insert member. Depressing the button preferably aligns the teeth with a slot in the lock, the slot having a width through which the teeth may slidably move, therein uncoupling the lock from the insert member and enabling slidable movement of the teeth through the slot. An upper portion of the lock preferably extends above the valley and the height of the peaks of the adjacent teeth, and a lower portion of the lock is positioned within the valley. Preferably the lower portion and only part of the upper portion of the lock comprises the slot. More preferably, the button comprises the slot. Therefore, when the lock has been uncoupled from the insert member when the button has been depressed, the slot aligns with the teeth enabling slidable movement of the teeth through the slot. Preferably, releasing the button when the lock is aligned with a valley releasably couples the lock to the insert member, wherein the valley comprises a locking position.

A surface of the undepressed button is preferably aligned flush with the outer fin surface. That surface comprises the top of the button which a user can depress to manipulate the lock. As the button is aligned flush with the outer fin surface, no additional drag is preferably created adjacent to that outer fin surface. The button may be constructed from a variety of materials. Preferably, the button is constructed from the same material as the fin section.

A user can preferably apply sufficient manual force by hand to depress the button and adjust the position of the fin section relative to the base when the adjustable fin is mounted to a surfboard.

Second Embodiment

In a second embodiment, the invention provides a dual fin comprising a fin section, a second fin section and a base, the base comprising a mount for attaching the dual fin to a surfboard.

In preferred examples of the second embodiment of the invention, a second fin section is attached to the fin section according to the first embodiment of the adjustable fin of the invention, the second fin section comprising two outer fin surfaces which meet at a leading edge and a trailing edge, and an underside surface.

The second fin section is preferably attached to the fin section by one or more attachment. Attachments may, in some non-limiting examples, comprise rods, plates, pins, bars, and/or be formed from a portion of either the fin section or the second fin section. More preferably, the one or more attachments comprise one or more ribs. The one or more attachments preferably preserve a minimum distance between the fin section and the second fin section of between approximately 0.1 mm and 5 mm. The one or more attachments preferably preserve a minimum distance between the fin section and the second fin section of between approximately 0.25 mm and 1.5 mm. The one or more attachments more preferably preserve a minimum distance between the fin section and the second fin section of approximately 1 mm. The attachments preferably reduce or remove any fluttering effect on either fin section caused by water passing around and between the fin section and the second fin section.

The second fin section is preferably positioned substantially parallel to the fin section and offset such that the leading edge of the second fin section is not aligned with the leading edge of the fin section. The fin section preferably comprises a flat foil having a substantially flat outer fin surface, and a curved outer fin surface. The second fin section also preferably comprises a flat foil having a substantially flat outer fin surface, and a curved outer fin surface. In a preferred example, the substantially flat outer fin surface of the fin section and substantially flat outer fin surface of the second fin section substantially face the same direction, and the leading edge of the fin section is in a position forward of the leading edge of the second fin section. Preferably, the leading edge of the fin section is forward of the leading edge of the second fin section by approximately 5 mm to 25 mm, and more preferably by approximately 10 mm.

The second fin section preferably comprises at least one passage through which water can pass. The passage comprises an opening on each outer fin surface of the second fin section through which water can enter and exit. The passage preferably comprises an opening on the substantially flat outer fin surface, and an opening on the curved outer fin surface, and the opening on the curved outer fin surface is located between the trailing edge of the second fin section and the minimum distance between the fin section and the second fin section. Preferably, the opening of the passage on the substantially flat outer fin surface of the second fin section is located closer to the leading edge of the second fin section than the opening of the passage on the curved outer fin surface of the second fin section. This will mean that when in normal use on a surfboard, water will preferentially enter the opening on the substantially flat outer fin surface, pass through the passage, and exit through the opening on the curved outer fin surface. A passage and an opening to a passage through the second fin section is preferably not round or another shape that would cause water passing through the passage to form a vortex. The openings and passages may be created from drilling or cutting holes or perforations through the second fin section or from the shape of a mould used to make the fin section.

An adjustable dual fin according to the second embodiment of the invention is preferably mounted in the position of a side fin on a surfboard wherein:

- the fin section and second fin section comprise flat foils having a substantially flat outer fin surface facing the centre line or stringer of the surfboard, and a curved outer fin surface facing the adjacent rail of the surfboard;
- the fin section is in a position closer to the adjacent rail of the surfboard than the second fin section; and
- the leading edge of the fin section is positioned closer to the front of the board than the leading edge of the second fin section.

Two or more adjustable dual fins according to the second embodiment of the invention may be mounted to a surfboard.

In a preferred example, the second fin section comprises at least one passage comprising an opening on the substantially flat outer fin surface, and an opening on the curved outer fin surface of the second fin section through which water can pass. When the adjustable dual fin of the second embodiment of the invention is mounted to a surfboard which is moving in a substantially forward direction through water during normal use, the at least one passage in the second fin section is preferably configured to:

- enable water to enter an opening on the substantially flat outer fin surface of the second fin section, pass through the passage, and exit through an opening on the curved outer fin surface in a location between the trailing edge of the second fin section and the position of the minimum distance between the fin section and the second fin section; and
- substantially prevent water passing in the reverse direction through the passage.

The openings preferably comprise holes or perforations on the surface of the substantially flat and curved outer fin surfaces of the second fin section through which water can enter and exit, respectively. Preferably, the opening on the substantially flat outer fin surface of the second fin section is positioned closer to the leading edge than the opening on the curved outer fin surface.

In an alternative example of the second embodiment of the adjustable dual fin of the invention, both the fin section and the second fin section are attached to the base. The fin section may be an adjustable fin according to the first embodiment of the invention. The second fin section may be an adjustable fin according to the first embodiment of the invention.

The second fin section may be the same size or a different size to the fin section. The second fin section may have a different fin template to the fin section. Preferably, the size and template of the second fin section is similar or the same as the size and template of the fin section.

The mount for an adjustable fin of the invention as herein described may comprise a variety of means known for mounting or attaching a fin to a surfboard or another board.

In a preferred example, the mount comprises one or more mounting blocks for attaching to one or more surfboard fin plugs and/or fin boxes. The one or more mounting blocks are preferably compatible with commercially available fin plug and/or fin box systems. Preferably, the one or more mounting blocks can be mounted to commercially available FCS® fin plugs and/or Futures® fin boxes.

In another preferred example, the mount comprises a base attachment surface and an adhesive wherein the adhesive directly and fixedly secures the base attachment surface to the outer bottom surface of the surfboard. The adhesive is preferably Araldite® or another epoxy or non-latex construction silicone adhesive that can maintain an adhesive connection between an adjustable fin of the invention and a surfboard or another board, particularly when exposed to water. Preferably, one or more screws additionally secure the adhered base attachment surface to the surfboard. Said screws are preferably placed in front of the leading edge of the adjustable fin and adjacent to each outer fin surface. The screws can preferably be turned with a hex or Allen key and screw plugs, for example, plastic screw plugs, and may be pre-set in the surfboard into which the screws can be driven and embedded to secure the base of the adjustable fin to the surfboard. Alternatively, the base attachment surface may be 'fiberglassed' onto the surfboard using traditional 'glassing' methods known in the art. For example, comprising placing 'rovings' around the outer edge or border of the base attachment surface.

The base attachment surface may also be used to attach a non-adjustable fin to a surfboard, for example a non-adjustable fin with a removable fin section.

Adjustment Indicators

Means for showing the user the position of the fin section relative to the base are also within the scope of the invention. Such means may include adjustment indicators, markings or numbering on the fin section, transparent portions of the fin section, or a combination of these, as some non-limiting examples. These means would, for example, enable a user to determine whether two or more adjustable fins mounted as side fins on a board have been adjusted equally. In another example, a user could identify by these means the position of a fin section relative to its base when an adjustable fin of the invention is mounted to a board, without having to manipulate or even touch the adjustable fin.

Elevated Fin Section

In an example of the first or second embodiments of the invention as herein described, the underside surface of the fin section abuts or aligns flush to the outer surface of a surfboard the adjustable fin is mounted to.

In another example of the first or second embodiments of the invention as herein described, the adjustable fin comprises an extended base which forms a gap between the underside surface of the fin section and the outer surface of a surfboard on which it is mounted. The length of the gap between the underside surface of the fin section and the outer surface of the surfboard is preferably between approximately 5 mm and 25 mm. The length of the gap is more preferably approximately between approximately 10 mm and 20 mm. The length of the gap is more preferably approximately 15 mm. Without wanting to be limited by any one theory, a benefit of elevating a fin section from the outer surface of a surfboard on which it is mounted is to reduce drag, when compared to a fin section which abuts or aligns flush with the outer surface of a surfboard.

Board Type

The adjustable fin of the first or second embodiments of the invention as herein described may be mounted to any one of the boards in the group comprising: surfboard, shortboard, kneeboard, longboard, minimal, soft board, kiteboard or a board used for kite surfing, wind surfer, stand up paddleboard, wakeboard, rescue board, bodyboard, or another board used in surface water sports or activities. Reference herein to a surfboard can also include reference to any one of these other boards.

Fin Arrangement

More than one adjustable fin according to any of the embodiments and examples of the invention as described herein may be mounted to a surfboard. For example, a thruster fin setup on a surfboard may comprise up to three adjustable fins of the invention as described herein. In some other non-limiting examples, other arrangements may include:

- Three adjustable fins according to the first embodiment of the invention wherein the two side fins are flat foils and the three adjustable fins are in a 'thruster' arrangement;
- Two adjustable fins according to examples of the first embodiment of the invention which are flat foils, and a non-adjustable centre fin;
- An adjustable centre fin according to examples of the first embodiment of the invention, and two non-adjustable side fin flat foils in a 'thruster' or another arrangement;
- An adjustable centre fin according to an example of the first embodiment of the invention, and two adjustable dual side fins according to an example of the second embodiment of the invention;
- Adjustable side fins according to examples of the first embodiment of the invention, and a dual centre fin according to an example of the second embodiment of the invention; or
- Another possible combination.

Therefore, various combinations are possible for using adjustable fins of the invention exclusively, or in combination with non-adjustable or other types of fins on a surfboard.

Process for Mounting a Fin of the Invention

The present invention further provides a process of mounting to a surfboard or another board, an adjustable fin of the invention as herein described. The present invention also provides a process of mounting an adjustable fin of the invention to a surfboard by mounting the adjustable fin using a mount as described herein.

Process for Manufacturing a Fin of the Invention

The present invention also provides a process of manufacturing an adjustable fin of the invention as described herein. The adjustable fin of the invention is preferably constructed from common materials used to make surfboard fins. In one example of the invention, part or all of the base is constructed from a metal or a metal alloy. This metal is preferably strong, light weight, and incapable of rusting or significant corrosion. In one example, the metal is aluminium. The fin section may be formed from two halves joined together.

Similarly to the large number of different fins currently available for mounting to a surfboard or another type of board described herein, an adjustable fin of the invention can comprise a variety of different: shapes or templates or even cants; outer fin surface shapes or features; sizes; types of foils; colours; materials from which the fin section is constructed; rakes; depths; widths; cants; cut-outs; and other designs and extensions including channels, 'tunnels' and 'wings', amongst others. In this regard, a user can select and mount an adjustable fin of the invention to a board with attributes that is desired by the user or suitable for the user's requirements and appropriate for the board the adjustable fin or fins are mounted on.

In developing the present invention, the inventor addressed many issues that have prevented successful uptake of adjustable fin systems by surfers and other board riders.

A first benefit is that no tools are required to adjust the position of the adjustable fin on the surfboard. This means that a surfer or another board rider can easily adjust the position of one or more adjustable fins of the invention on their board without leaving the water. This allows the 'fine tuning' of their board to adjust to a much greater range of swell sizes and conditions without paddling in to the beach to swap fins and/or surfboards, and no need for tools or equipment.

A second benefit is that the adjustable fin of the invention can incorporate mounting blocks that attach to existing fin plug and fin box arrangements such as FCS® fin plugs or Futures® fin boxes. As a result, surfers and other board riders do not have to purchase a new board having a specific fin plug or box arrangement but can use one or more adjustable fins of the invention in their current boards, and without any modifications to their boards.

The adjustable fin according to an example of the second embodiment of the invention provides a third benefit of directing thrust in a direction substantially towards the front of the board with an aim of increasing board speed on a wave.

DESCRIPTION OF PREFERRED EMBODIMENTS

Those skilled in the art will appreciate that the invention described herein is susceptible to variations and modifications other than those specifically described. It is to be understood that the invention includes all such variations and modifications. The invention also includes all of the steps, features, compositions and compounds referred to or indicated in the specification, individually or collectively and any and all combinations or any two or more of the steps or features.

The present invention is not to be limited in scope by the specific examples described herein, which are intended for the purpose of exemplification only. Functionally equivalent products, compositions and methods are clearly within the scope of the invention as described herein.

Throughout this specification, unless the context requires otherwise, the word "comprise", or variations such as "comprises" or "comprising", will be understood to imply the inclusion of a stated integer or group of integers but not the exclusion of any other integer or group of integers.

Other definitions for selected terms used herein may be found within the detailed description of the invention and apply throughout. Unless otherwise defined, all other scientific and technical terms used herein have the same meaning as commonly understood to one of ordinary skill in the art to which the invention belongs.

Features of the invention will now be discussed with reference to the following preferred examples.

First Embodiment of the Invention

Figure 1:
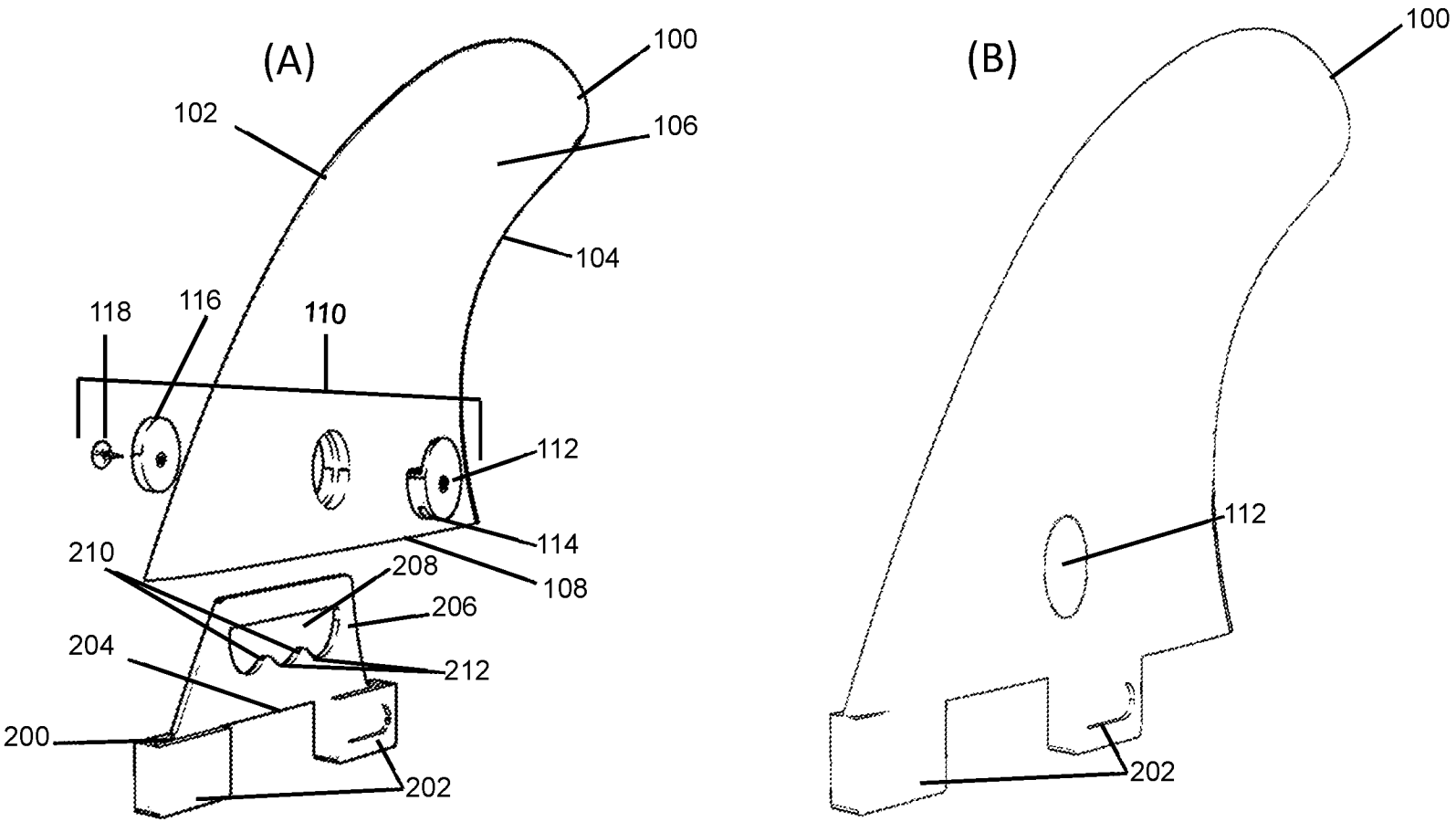
FIG. 1. are illustrations showing oblique views of an exploded (A) and assembled (B) example of the first embodiment of the adjustable fin of the invention. Mount comprises mounting blocks which attach to FCS® fin plugs.

A preferred example of the first embodiment of the adjustable fin of the invention is shown in FIG. 1. FIG. 1A illustrates an exploded view (and FIG. 1B an assembled view) wherein the fin section 100 has a leading edge 102 and a trailing edge 104 and outer fin surfaces 106 of which only one is visible in FIGS. 1A and 1B.

The base 200 comprises a mount 214 having two mounting blocks 202 which are compatible with the existing commercially available FCS® fin plugs fitted to a majority of existing surfboards. When the adjustable fin is mounted on to a surfboard, the mounting blocks 202 are secured within FCS® fin plugs and the underside surface 108 of the fin section 100 and bottom surface 204 of the base abut, i.e. align with the bottom surface of the surfboard.

The base 200 comprises an insert member 206 which extends in a direction contrary to that of the mounting blocks 202. The insert member 206 comprises a planar surface with a hole 208 cut out. The hole 208 is shaped to comprise teeth 210 and valleys 212.

The fin section 100 comprises a lock 110 which is shown in FIG. 1A disassembled into three components, one component comprising the button 112 of the lock 110, another component comprising a button support 116, and the other component comprising a button support pin 118 that connects the button support 116 to the button 112. FIG. 1B shows that the button 112 on the assembled fin lies flush to the outer fin surface 106. The underside of the button 112 comprises a slot 114 which when the button 112 is depressed on the assembled adjustable fin, the slot 114 aligns with the teeth 210 enabling the teeth 210 which have a width thinner than the width of the slot 114, to pass through the slot 114. The button 112 is biased towards releasably coupling the lock 110 to the insert member 206, and lying flush to the outer fin surface 106.

Figure 2:
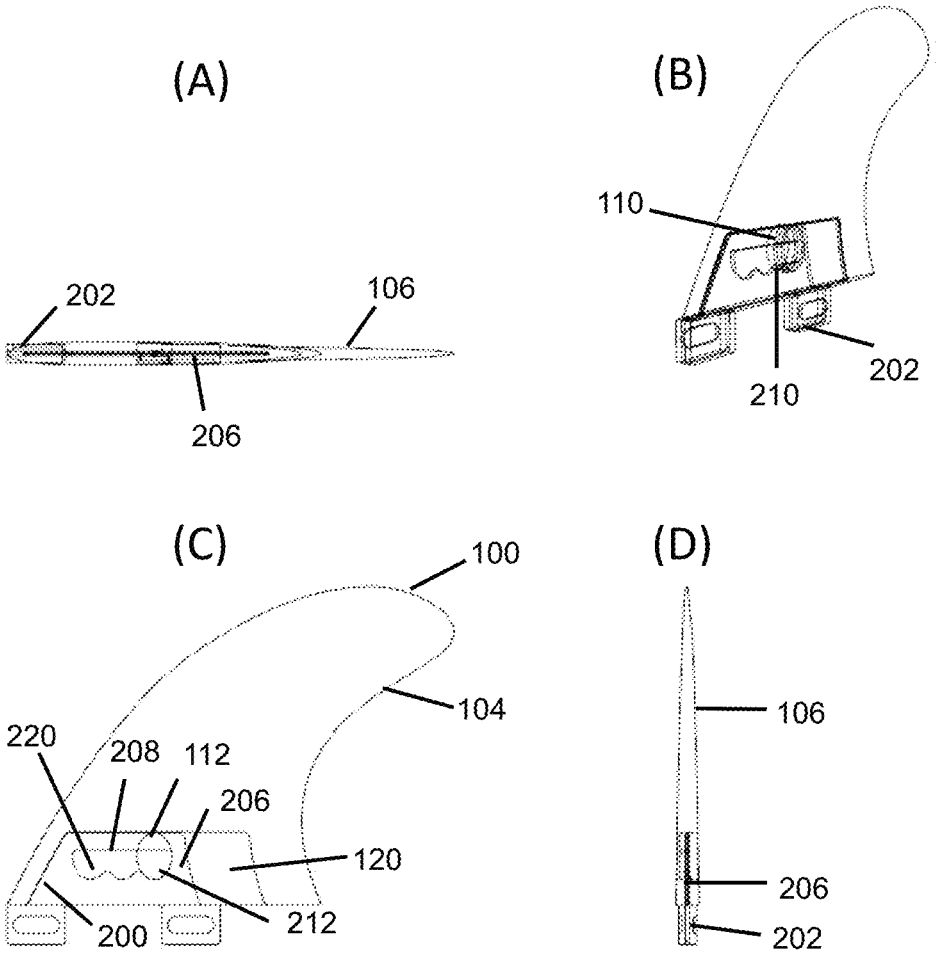
FIG. 2. are illustrations showing a top view (A), oblique view (B), side view (C) and front view (D) and the internal mechanism of an example of the first embodiment of the adjustable fin of the invention. Mount comprises mounting blocks which attach to FCS® fin plugs.

FIG. 2 illustrates the internal mechanism and interaction between fin section 100 and base 200 when this preferred example of the first embodiment of the adjustable fin of the invention is assembled.

In FIG. 2, the lock 110 is releasably coupled in a locking position formed by a valley 212 in the hole 208 of the insert member 206. The internal cavity 120 in the fin section 100 is configured to enable the insert member 206 to slidably move by manual force in a direction towards the trailing edge 104. This can take place after the lock 110 is uncoupled from the insert member 206 when the button 112 is depressed by manual force and the slot in the button 112 is aligned with the teeth 210 allowing the teeth 210 to pass through the slot of the button 112. When the lock 110 is in alignment with another locking position, for example, formed by a second valley 220, release of the button 112 will move the slot of the button 112 out of alignment with the teeth 210 and the teeth 210 will no longer be able to pass through the slot of the button 112. As a result, the lock 110 will be restrained in the locking position formed by the second valley 220 and therefore releasably coupled to the insert member 206.

Figure 3:
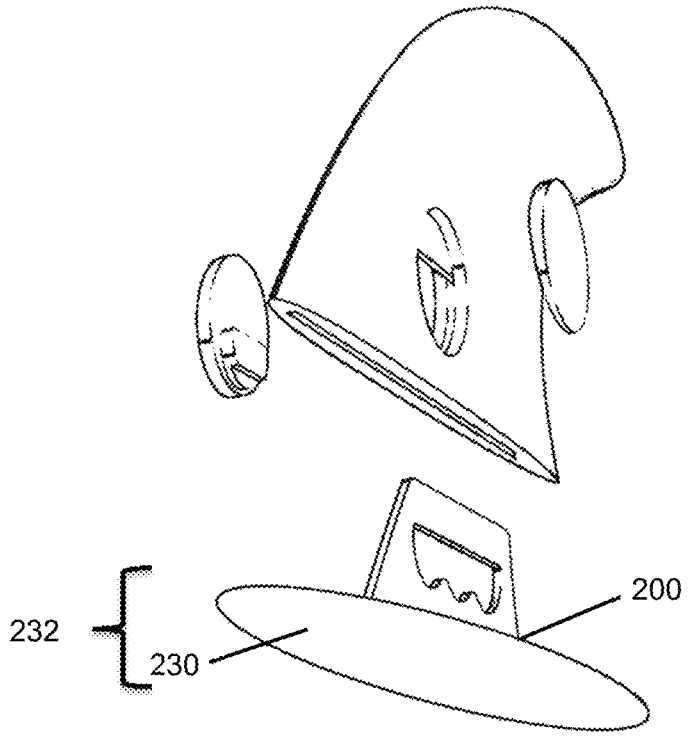
FIG. 3. are illustrations showing oblique views of an exploded example of the first embodiment of the adjustable fin of the invention (A) and when mounted to a surfboard (B). Mount comprises a base attachment surface and an adhesive.
Figure 3:
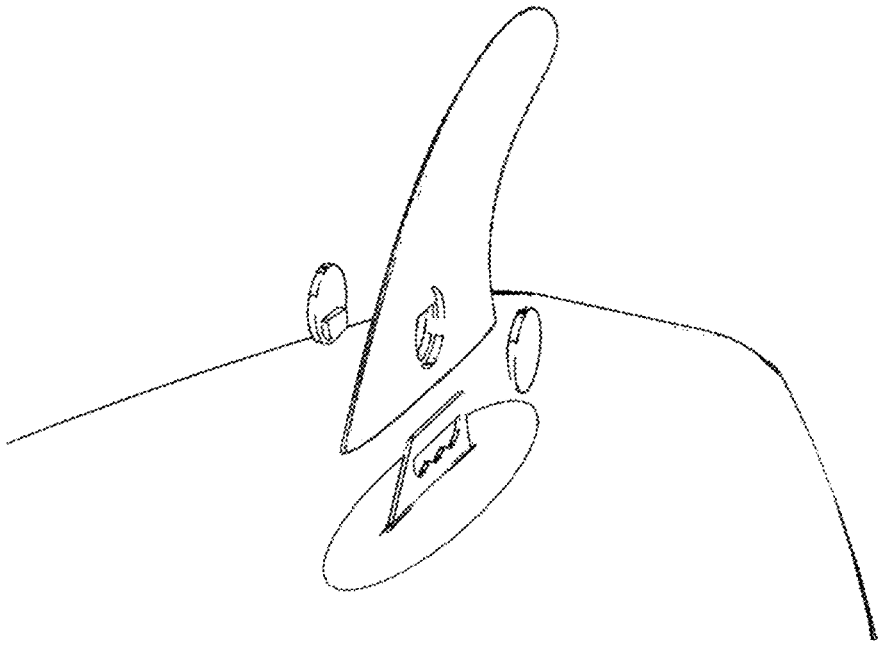

FIG. 3A shows an illustration of an example of the first embodiment of the adjustable fin of the invention with a mount on the base 200 which comprises a base attachment surface 230 to which an adhesive and, in some non-limiting examples, screws, are used to attach the adjustable fin to a surfboard (FIG. 3B).

Second Embodiment of the Invention

Figure 4:
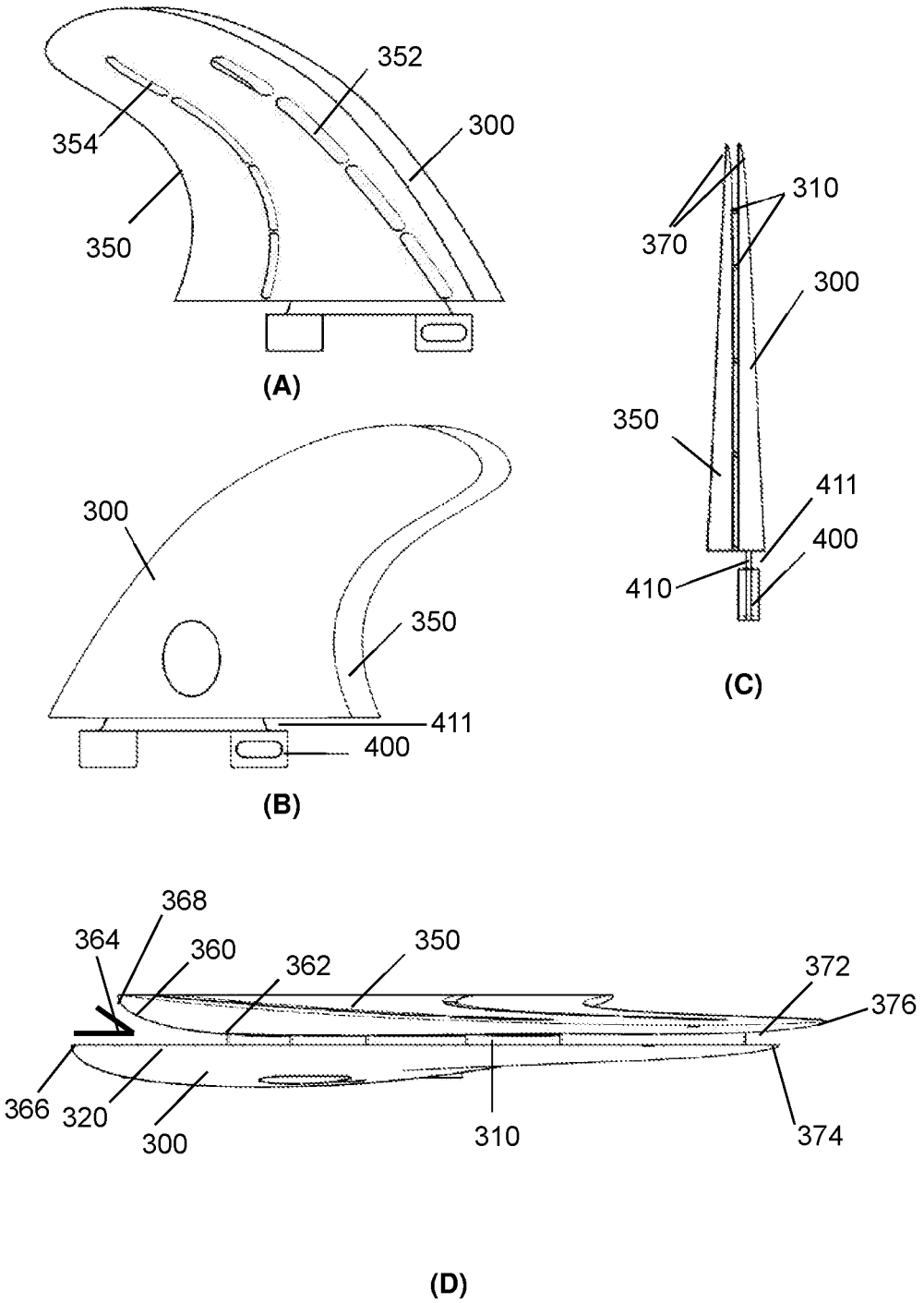
FIG. 4. are illustrations showing a side view (A), the opposing side view (B), front view (C) and top view (D) of an example of the second embodiment of the adjustable dual fin of the invention. Mount comprises mounting blocks which attach to FCS® fin plugs.

In an example of the second embodiment of the present invention, an adjustable dual fin is shown in FIG. 4. The adjustable dual fin comprises the adjustable fin of the first embodiment of the invention with a fin section 300 and a base 400, wherein a second fin section 350 is attached to the fin section 300 by five attachments 310 of different lengths. Both the fin section 300 and the second fin section 350 are flat foils with substantially flat outer fin surfaces on one side and curved outer fin surfaces on the other side. The leading edge of the fin section 300 is positioned forward of the leading edge of the second fin section. Leading edge passages 352 and trailing edge passages 354 through the second fin section 350 are angled towards the curved outer fin surface which forces water to pass through the passage and into the gap between the fin section 300 and second fin section 350. The example further comprises an extended base member 410 such that when the adjustable dual fin is mounted on a surfboard, there is a gap 411 between the outer surface of the surfboard and the underside surfaces of the fin section 300 and second fin section 350. The bases of the example comprise mounting blocks which can attach to existing available FCS® fin plugs.

Without wanting to be limited by any one theory, it is believed that this example of the adjustable dual fin of the second embodiment of the invention provides a benefit of increased thrust and therefore speed in a direction substantially towards the front of a surfboard it is mounted to when in normal use, for the following reasons.

As shown in the example in FIG. 4, the distance between the flat outer fin surface 320 of the fin section 300, and the curved outer fin surface 360 of the second fin section 350 is nearest at the peak 362 of the curved outer fin surface 360 of the second fin section 350. This distance is preferably between approximately 0.1 mm and 5 mm, more preferably between approximately 0.25 mm and 1.5 mm, and even more preferably approximately 1 mm. The proximity and position of the fin section 300 and the second fin section 350 forms a V-shaped channel 364 between the peak 362 and the leading edge 366 of the fin section 300 and the leading edge 368 of the second fin section 350, the V-shaped channel 364 extending along the curved length of the fin sections to their tips 370. On the other side of the peak 362 is a rear chamber 372 formed between the peak 362 and the trailing edge 374 of the fin section 300 and the trailing edge 376 of the second fin section 350.

During normal use when mounted on a surfboard, water passes into the V-shaped channel but only a small amount of this water can pass between the thin gap between the fin section and the second fin section. The majority of the water is forced along the length of the V-shaped channel towards the tip of the fin sections at a higher velocity than the normal speed that water is passing the fin sections. This higher velocity is generated due to the higher pressure behind the water forced into the channel than the pressure of the water in front of the water leaving the channel adjacent to the tips of the fin sections according to Newton's 2nd law. In accordance with Bernoulli's principle, the increase in the velocity of the water occurs simultaneously with a decrease in pressure. Therefore, a region of low pressure is created in this V-shaped channel.

Conversely, some water passes through the thin gap between the fin section and the second fin section, and passages direct water through the second fin section from the side of the substantially flat outer fin surface into the rear chamber. The effect of forcing all of this water into the limited space of the rear chamber results in the creation of a region of high pressure.

The pressure differential between the area of low pressure in the V-shaped channel and the area of high pressure in the rear chamber results in a lift force acting perpendicular to the direction of the fluid flow in the V-shaped channel. That is, in a direction towards the front of the fin on a slight downward angle. The thrust provided by this lift force acts to increase the overall speed of the fins in this direction, and therefore, the board through the water.

Figure 5:
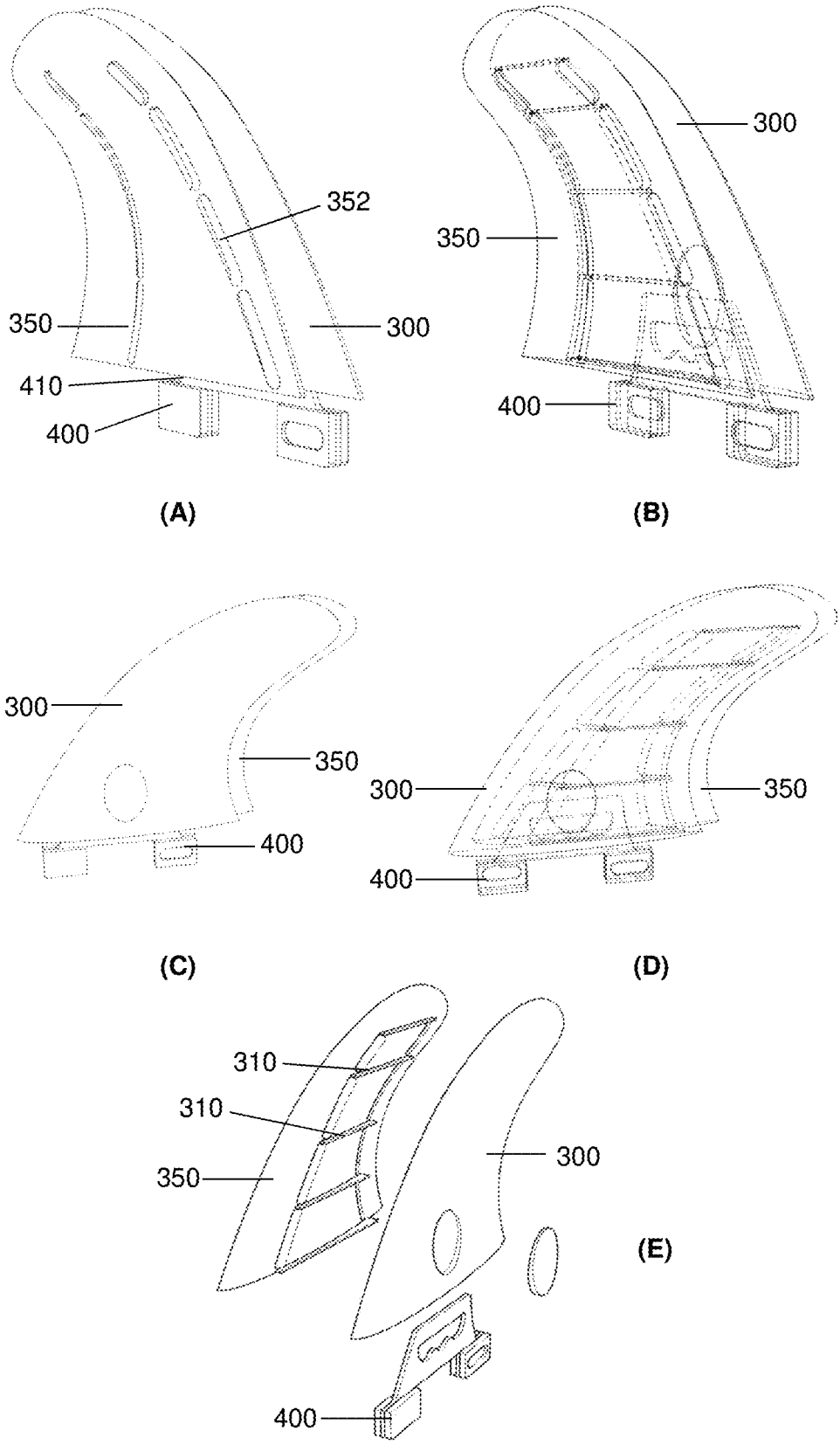
FIG. 5. are illustrations showing an oblique view (A), blueprint of the oblique view (B), side view (C), blueprint of the side view (D), and an exploded oblique view (E) of an example of the second embodiment of the adjustable dual fin of the invention. Mount comprises mounting blocks which attach to FCS® fin plugs.

FIGS. 5B and 5D show the internal structure and mechanism from different views of the same example of the second embodiment of the adjustable dual fin of the invention shown in FIGS. 5A and 5C, respectively. FIG. 5E shows an exploded view of the same example. The bases comprise mounting blocks which can attach to existing available FCS® fin plugs.

Figure 6:
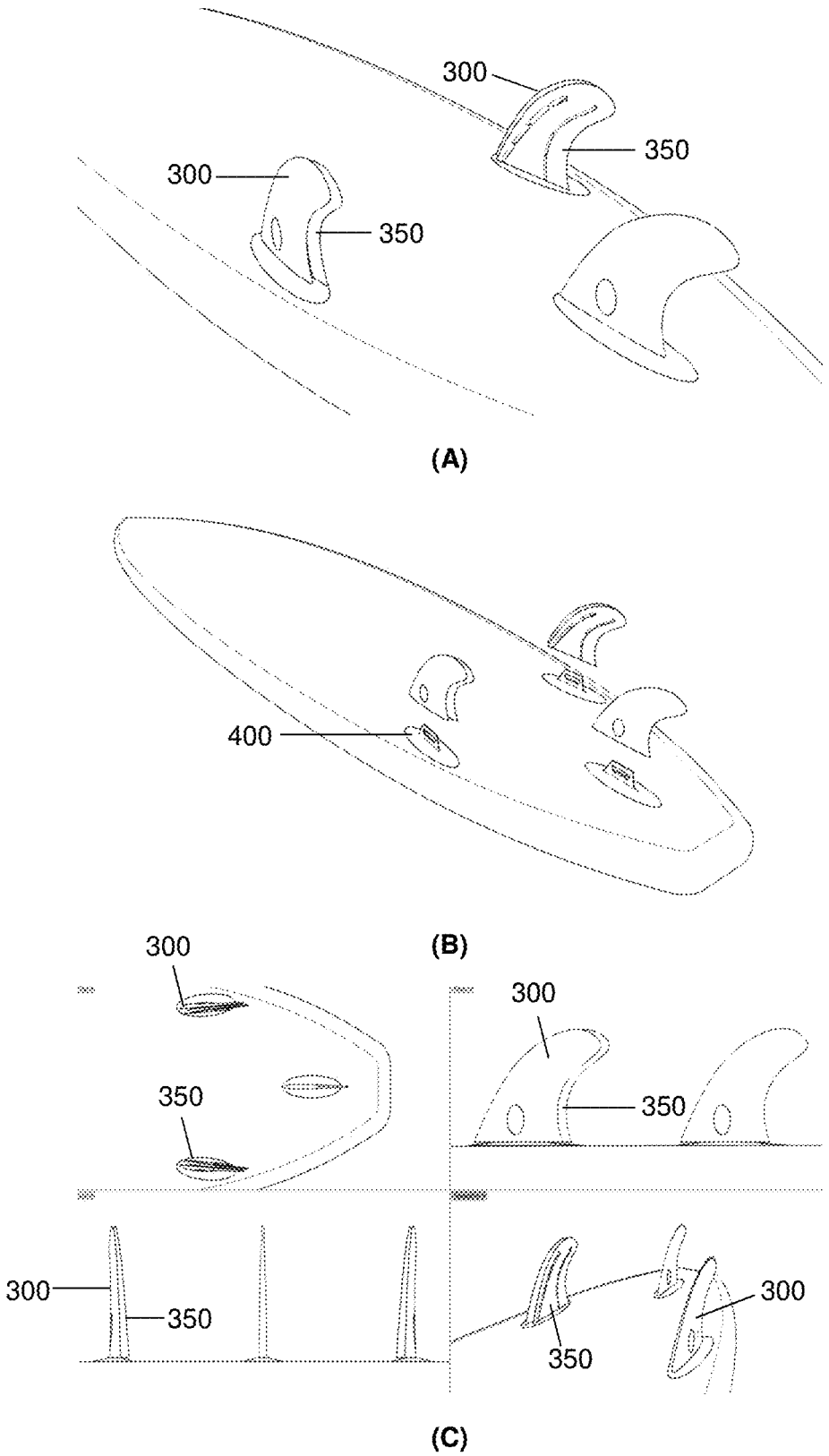
FIG. 6. are illustrations showing oblique view (A), oblique exploded view (B), and (clockwise from top left) top, side, oblique and front view (C) of adjustable fins of the invention mounted by a base attachment surface and an adhesive to a surfboard, with adjustable dual fins of an example of the second embodiment of the invention mounted as side fins, and an adjustable fin of an example of the first embodiment of the invention mounted as the centre fin.

Example of the adjustable fin and adjustable dual fin of the invention which have been mounted onto a surfboard are shown in FIG. 6. The mount for these examples comprises a base attachment surface which attaches to the surfboard by an adhesive. An adjustable fin according to the first embodiment of the invention is mounted to the surfboard as a centre fin. Mounted to the surfboard as side fins are adjustable dual fins according to examples of the second embodiment of the invention.

The invention claimed is:

1. A dual fin for use on a surfboard, the dual fin comprising:

a fin section comprising two outer fin surfaces which meet at a leading edge and a trailing edge, wherein the fin section is elongated in a first direction from the leading edge to the trailing edge;

a second fin section comprising two outer fin surfaces which meet at a leading edge and a trailing edge, wherein the second fin section is elongated in a second direction from the leading edge to the trailing edge, and a base, comprising a mount for attaching the dual fin to a surfboard wherein an outer fin surface of the fin section is positioned adjacent to and facing an outer fin surface of the second fin section such that the first direction and second direction are substantially parallel.

2. A dual fin according to claim 1, wherein the second fin section is attached to the fin section by an attachment.

3. A dual fin according to claim 2, wherein the attachment comprises a rib.

4. A dual fin according to claim 2, wherein the attachment preserves a minimum distance between the fin section and the second fin section of between approximately 0.25 mm and 1.5 mm.

5. The dual fin according to claim 1, wherein the fin section comprises a flat foil having a flat outer fin surface, and a curved outer fin surface.

6. The dual fin according to claim 5, wherein the second fin section comprises a flat foil having a flat outer fin surface and a curved outer fin surface, wherein the flat outer fin surface of the second fin section and the flat outer fin surface of the fin section both face a same direction.

7. The dual fin according to claim 6, wherein the flat outer fin surface of the fin section faces the curved outer fin surface of the second fin section.

8. The dual fin according to claim 1, wherein the second fin section is positioned parallel to the fin section and offset such that the leading edge of the second fin section is not aligned with the leading edge of the fin section.

9. The dual fin according to claim 1, comprising a passage through the second fin section through which water can pass, wherein the passage comprises an opening on the two outer fin surfaces of the second fin section through which water can enter and/or exit.

10. The dual fin according to claim 9, comprising a passage through the second fin section through which water can pass, wherein:

the passage comprises an opening on the flat outer fin surface, and an opening on the curved outer fin surface, and the opening on the curved outer fin surface is located between the trailing edge of the second fin section and the minimum distance between the fin section and the second fin section;

the opening of the passage on the flat outer fin surface is located closer to the leading edge of the second fin section than the opening of the passage on the curved outer fin surface of the second fin section; and water can enter the opening on the flat outer fin surface, pass through the passage, and exit through the opening on the curved outer fin surface.

11. The dual fin according to claim 10, wherein water can enter the opening of the passage on the flat outer fin surface, pass through the passage, and exit through the opening of the passage on the curved outer fin surface.

12. The dual fin according to claim 1, wherein the mount comprises a mounting block capable of attaching to fin plug and fin box systems.

13. The dual fin according to claim 1, wherein the mount comprises a base attachment surface and an adhesive for mounting the dual fin to an outer surface of a surfboard.

14. The dual fin according to claim 1, comprising an extended base, wherein when the dual fin is mounted on a surfboard, the extended base forms a gap between the outer surface of the surfboard and the fin section and second fin section.

15. The dual fin according to claim 14, wherein the gap is between approximately 10 mm and 20 mm long.

16. The dual fin according to claim 1, for mounting to any one of the boards in the group comprising: surfboard, shortboard, kneeboard, longboard, minimal, soft board, kiteboard, wind surfer, stand up paddleboard, wakeboard, rescue board, bodyboard, or another board used in surface water sports or activities.

17. A process comprising the step of mounting a dual fin according to claim 1, to any one of the boards in the group comprising: a surfboard, a shortboard, a kneeboard, a longboard, a minimal, soft board, a kiteboard, a wind surfer, a stand up paddleboard, a wakeboard, a rescue board, a bodyboard, or another board used in surface water sports or activities.

* * * * *